US005252100A

United States Patent [19]

Osawa et al.

[11] Patent Number: 5,252,100

[45] Date of Patent: Oct. 12, 1993

[54] VARIABLE ROTOR-BLADE-ATTACK ANGLE HELICOPTER TOY

[75] Inventors: Kenichi Osawa; Takeshi Kishi, both of Tokyo, Japan

[73] Assignee: Wildgear Inc., Tokyo, Japan

[21] Appl. No.: 527,917

[22] Filed: May 24, 1990

[30] Foreign Application Priority Data

Jun. 6, 1989 [JP] Japan ..... 1-143477

[51] Int. Cl.[5] ..... A63H 27/127; B64C 11/34

[52] U.S. Cl. ..... 446/44; 446/38; 244/17.13

[58] Field of Search ..... 244/17.13, 17.11; 446/44, 39, 38, 37, 36, 34, 33, 31, 30, 486

[56] References Cited

U.S. PATENT DOCUMENTS

| | | | |
|---|---|---|---|
| 2,178,014 | 10/1939 | Brown | 446/37 |
| 2,308,916 | 1/1943 | Halligan et al. | 446/44 |
| 3,127,696 | 4/1964 | Pagliuso | 446/37 |
| 3,213,944 | 10/1965 | Nichols et al. | 446/37 A |
| 4,084,345 | 4/1978 | Tanaka | 446/44 |
| 4,674,986 | 6/1987 | Ueda | 446/39 |

FOREIGN PATENT DOCUMENTS

| | | | |
|---|---|---|---|
| 194763 | 1/1958 | Austria | 446/36 |
| 3602100 | 8/1987 | Fed. Rep. of Germany | 446/36 |

*Primary Examiner*—Robert A. Hafer
*Assistant Examiner*—D. Neal Muir
*Attorney, Agent, or Firm*—Sughrue, Mion, Zinn, Macpeak & Seas

[57] ABSTRACT

In a helicopter toy, a plurality of rotor blades are mounted to a flying body for rotation about a rotational axis and for angular movement about their respective pivotal axes extending perpendicularly to the rotational axis so that the rotor blades have their respective angles of attack which can be altered in pitch. An attack-angle altering unit is provided for altering the angles of attack of the respective rotor blades such that, when a power is transmitted to the rotor blades from a power source to rotate the rotor blades about the rotational axis, the angles of attack of the respective rotor blades are brought to their respective plus pitches to climb the flying body, while, when the transmission of the power from the power source to the rotor blades is released, the angles of attack of the respective rotor blades are brought to their respective minus pitches to cause the flying body to descend.

19 Claims, 5 Drawing Sheets

VARIABLE ROTOR-BLADE-ATTACK ANGLE HELICOPTER TOY

BACKGROUND OF THE INVENTION

The present invention relates to a helicopter toy which is stably or steady in a flying body at during accent and which particularly secures stability of the flying body during descending.

A conventional helicopter toy is disclosed a, for example, in Japanese Patent Provisional Publication No. SHO 61-29381. The flying unit comprises a flying body, a plurality of rotor blades mounted to the flying body for rotation about a rotational axis and for angular movement about their respective pivotal axes extending perpendicularly to the rotational axis, a power source for giving a rotational force to the rotor blades to climb the flying body, and means for decreasing angles of attack of the respective rotor blades when transmission of power from the power source to the rotor blades is released, to stabilize the flying body while descending.

The power source uses a rubber material, and the rotor blades are as formed as to be moved angularly about their respective pivotal axes, by releasing forces due to twisting of elastic elements to their respective positions where the angles of attack of the respective rotor blades are lost. When the rubber material that is the power source is twisted several times, such action is generated to contract the rubber material so that a cap member pulled by the contracting action forcibly moves the rotor blades about their respective pivotal axes against the biasing forces of the respective elastic elements to cause the rotor blades to obtain a lifting power.

When the twisting of the elastic element is lost, the rubber material is lengthened or elongated in its length so that the cap member is returned to its original position by a biasing force of a spring so that the rotation of the rotor blades about the rotational axis is made free, and the angles of attack of the respective rotor blades are lost.

As described previously, when the rubber material is twisted several times, the angles of attack are given respectively to the rotor blades in such a direction as to cause the rotor blades to obtain their lifting power. At this time, if the rotor blades are rotated about the rotational axis by the releasing force from the twisting of the rubber material, the flying body lifts and climbs until the twisting force of the rubber material is lost.

When the twisting force of the rubber material is lost, the angles of attack of the respective rotor blades are lost so that the flying body is oriented horizontally and the rotor blades continue to be rotated about the rotational axis under a free condition. Since the rotor blades are rotated about the rotational axis, balance of the flying body is taken so that the flying body descends while maintaining its stable posture during ascent.

However, the conventional model flying unit has the following drawbacks.

That is, in the model flying unit, the rotor blades are rotated at descending about the rotational axis only by inertia of the rotor blades. Accordingly, if the ascending height is of the order of, for example, four (4) to five (5) meters, the rotor blades continue to be rotated about the rotational axis by the inertia of the rotor blades until the flying body lands. If the releasing force of the rubber material is strengthened so that the flying body climbs up to a location over the aforesaid ascending height, for example, of the order to ten (10) meters, however, a descending time is lengthened so that the rotation of the rotor blades due to their inertia is suspended on the way. Thus, balance of the flying body is lost or broken upon the suspension in rotation of the rotor blades so that the flying body falls down.

As a result, the following drawbacks arise. That is, the flying body falls like a crash not the flying condition so that the flying body spoils the fun. Further, descending under the falling condition increases the descending speed to damage the flying body.

SUMMARY OF THE INVENTION

It is therefore an object of the invention to provide a helicopter toy which is capable of descending stably or steadily even if a flying body climbs to any location, and which is simple in structure and low in cost.

According to the invention, there is provided a helicopter toy comprising:

a flying body;

a plurality of rotor blades mounted to the flying body for rotation about a rotational axis and for angular movement about their respective pivotal axes extending perpendicularly to the rotational axis so that the rotor blades have their respective angles of attack which can be altered in pitch;

a power source for giving a rotational force to the rotor blades to rotate the same about the rotational axis thereby climbing the flying body; and attack-angle altering means for altering the angles of attack of the respective rotor blades such that, when a power is transmitted to the rotor blades from the power source to rotate the rotor blades about the rotational axis, the angles of attack of the respective rotor blades are brought to their respective plus pitches to climb the flying body, while, when the transmission of the power from the power source to the rotor blades is released, the angles of attack of the respective rotor blades are brought to their respective minus pitches to cause the flying body to descend.

With the arrangement of the invention, at ascending of the flying body, the power is transmitted to the rotor blades from the power source so that the rotor blades are rotated about the rotational axis with respect to the flying body. At this time, the angles of attack of the respective rotor blades are brought to their respective plus pitches by the attack-angle altering means in such a direction as to climb the flying body. Thus, a lifting force is generated at the flying body.

When the power from the power source is lost, the transmission of the power is released, and the angles of attack of the respective rotor blades are brought to the minus pitches by the attack-angle altering means in such a direction to cause the flying body to descend. Under this condition, the rotor blades are rotated about the rotational axis by the rotational force due to inertia of the rotor blades. A rotational force in the ascending direction is applied to the flying body by the air flow or stream of air due to the descending movement of the flying body. Thus, the rotor blades continue to be rotated about the rotational axis even if the inertia force of the rotor blades is lost.

As a result, even if the rotational force due to the inertia of the rotor blades is lost, the rotor blades continue to be rotated about the rotational axis by the rotational force due to the minus pitches and the air flow. Accordingly, even if the flying body ascends to any location, the flying body can descend under a steady or stable condition. That is, the greatest feature or characteristic of the invention resides in the following point. Specifically, at the transmission of the power from the power source, the angles of attack of the respective rotor blades are brought to their respective plus pitches to lift the flying body. Upon releasing the power transmission, the angles of attack of the respective rotor blades are altered to their respective minus pitches to cause the flying body to descend. If the structure of the flying body is not so complicated, and if an especial stabilizing mechanism or the like is not provided separately, it can be secured to fly the helicopter toy always under the stable condition.

In the manner described above, according to the invention, there are obtained the following superior functional advantages. That is, even if the helicopter toy is lifted to any location, such an attempt can be made to cause the flying body to stably descend. Further, the helicopter toy is not particularly complicated in structure, and the cost of the helicopter toy can be reduced.

DESCRIPTION OF THE EMBODIMENTS

Figure 1:
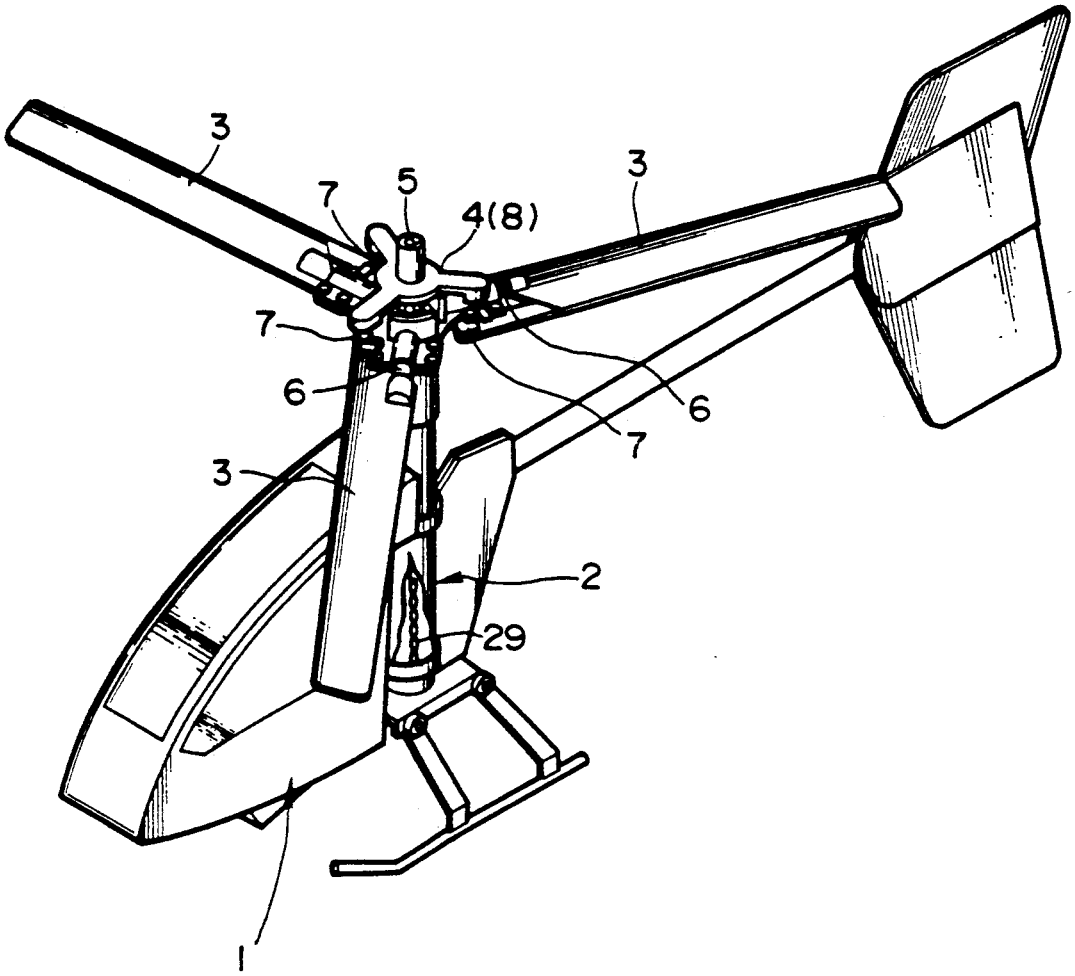
FIG. 1 is a perspective view of a helicopter toy according to a first embodiment of the invention.

Referring to FIG. 1, there is shown a helicopter toy according to a first embodiment of the invention. The helicopter toy comprises a flying body 1 having a head section and a tail section which are made of a lightweight material. A power source 2 is arranged at the center of the flying body 1 in the longitudinal direction thereof and extends vertically. The power source 2 has a tube-like rubber material 29.

An attack-angle altering mechanism 4 is arranged above the power source 2. A plurality of, three in the illustrated embodiment, rotor blades 3 are mounted to the attack-angle altering mechanism 4 for rotation about a vertical rotational axis and for angular movement about their respective pivotal axes extending perpendicularly to the rotational axis such that the rotor blades 3 have their respective pitches which can be altered.

Figure 2:
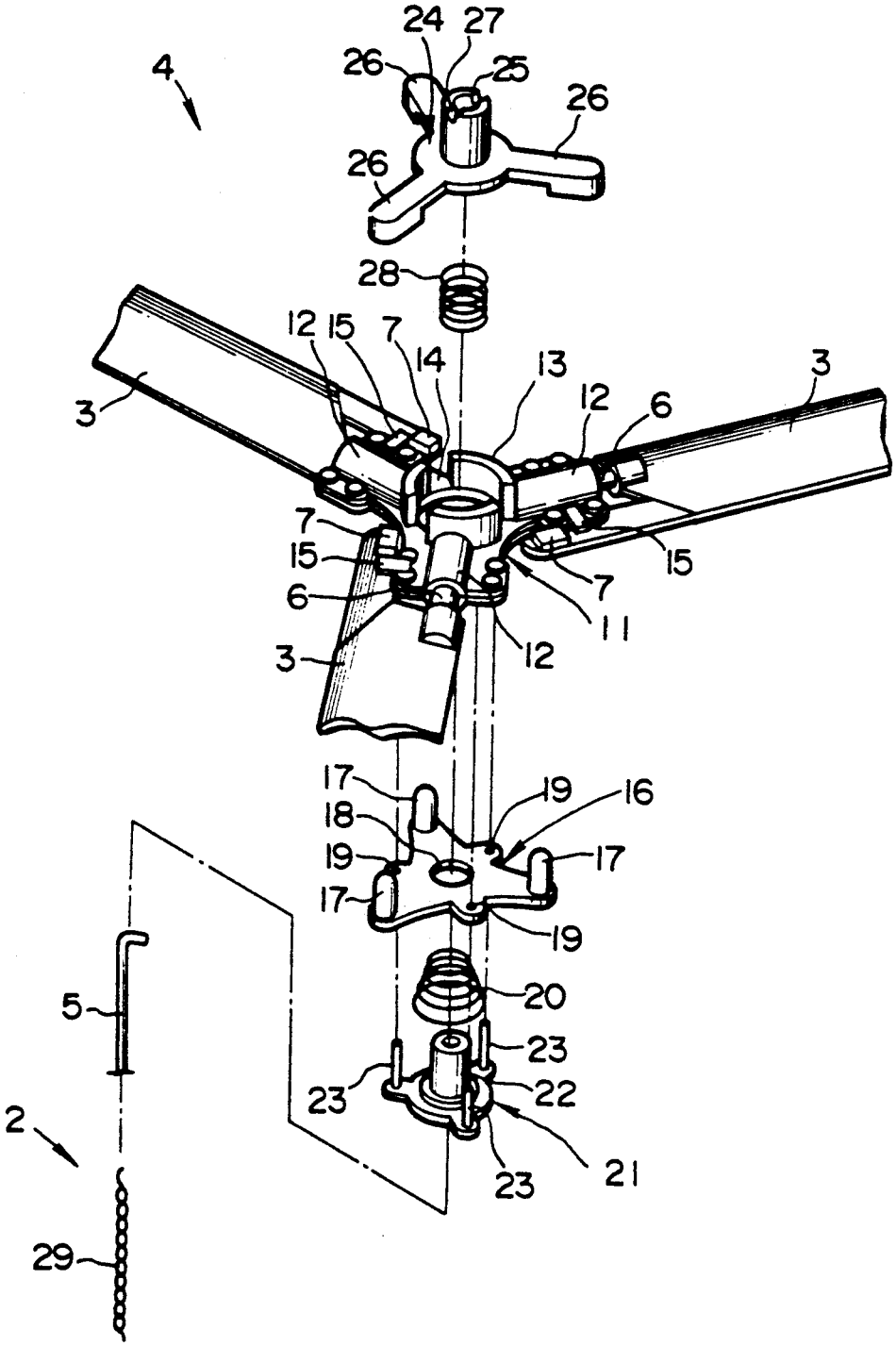
FIG. 2 is a fragmentary enlarged, exploded perspective view of an attack-angle altering mechanism of the helicopter toy illustrated in FIG. 1.

As shown in FIG. 2, the attack-angle altering mechanism 4 comprises a generally trifurcated rotor base 11 having three shaft supports 12 oriented respectively in three directions. The rotor blades 3 have, adjacent their respective base ends, their respective pivoting shafts 6 which are supported respectively in the shaft supports 12 for angular movement about their respective axes in conformity respectively with the above-mentioned pivotal axes of the respective rotor blades 3. The rotor blades 3 are formed such that their respective base ends extend to locations on the side of the shaft supports 12. Upper-limit restricting projections 15 are formed respectively on the side surfaces of the shaft supports 12 for restricting the rotor blades 3 such that the angles of attack of the respective rotor blades 3 are not brought to excessive negative pitches in a descent direction. An engaging tube 13 is provided at the center of the rotor base 11 and extends therefrom upwardly. The engaging tube 13 is hollow having an inner periphery which forms a through bore extending through the rotor base 11. The engaging tube 13 is provided therein with three engaging grooves 14, and three engaging rods 26 of a drive element 24 subsequently to be described are engaged respectively with the engaging grooves 14. The engaging grooves 14 are horizontally arranged correspondingly to the engaging rods 26. Three pushed projections 7 are formed respectively at the forward ends of the rotor blades 3. The pushed projections 7 are pushed respectively by the engaging rods 26 of the drive element 24 to alter the rotor blades 3 to their respective plus pitches.

In connection with the above, the rotor base 11 per se is made of, for example, a plastic material. Each of the shaft supports 12 is formed into two pieces, and the two pieces are bonded to each other to form a corresponding one of the shaft supports 12 for supporting respectively the pivoting shafts 6 of the respective rotor blades 3.

A pushing-up element 16 and a pushing-up base 21 are arranged below the rotor base 11 with the pushing-up element 16 located between the rotor base 11 and the pushing-up base 21.

The pushing-up element 16 is formed by a trifurcated plate member having three legs whose forward ends are formed respectively with pushing-up projections 17 extending upwardly. A through bore 18 is formed at the center of the pushing-up element 16. The pushing-up element 16 has three intermediate sections between the legs, and the three intermediate sections are formed respectively with detent through bores 19. Detent rods 23 of the pushing-up element 21 extend respectively through the detent through bores 19. The detent rods 23 and the detent through bores 19 serve respectively as detents.

The pushing-up base 21 is formed by a circular plate material whose peripheral edge is formed with three projecting pieces. The detent rods 23 are mounted respectively to the projecting pieces in an upstanding manner. The detent rods 23 correspond in position respectively to the detent through bores 19 in the pushing-up element 16. A tubular base shaft 22 is provided at the center of the pushing-up base 21 and extends upwardly. The base shaft 22 is hollow having an inner periphery which forms a through bore extending through the pushing-up base 21.

On the other hand, the aforementioned drive element 24 is arranged above the rotor base 11, and is formed by a trifurcated plate member. A tubular drive connecting shaft 25 is provided at the center of the drive element 24, and extends upwardly. The drive connecting shaft 25 is hollow having an inner periphery which forms a through bore extending through the drive element 24. The trifurcated drive element 24 has three legs whose forward ends are provided respectively with the engaging rods 26. The engaging rods 26 are engaged respectively with the engaging grooves 14 in the engaging tube 13 to push the pushed projections 7 of the rotor blades 3 thereby altering the angles of attack of the respective rotor blades 3 to their respective positive pitches in the lifting direction.

As described above, the drive element 24 is movable between an engaging position where the drive element 24 is engaged with the rotor blades 3 to bring the angles of attack of the respective rotor blades 3 to their respective positive pitches, and a disengaging position where the drive element 24 is disengaged from the rotor blades 3 to permit the angles of attack of the respective rotor blades 3 to be brought to their respective minus pitches. The pushing-up element 16 is movable between a first position where the pushing-up element 16 maintains the rotor blades 3 at their respective minus pitches and a second position where the pushing-up element 16 is pushed by the drive element 24 through the pushed projections 7 of the respective rotor blades 3 when the drive element 24 occupies the engaging position, so that the rotor blades 3 are moved to their respective plus pitches.

Figure 3:
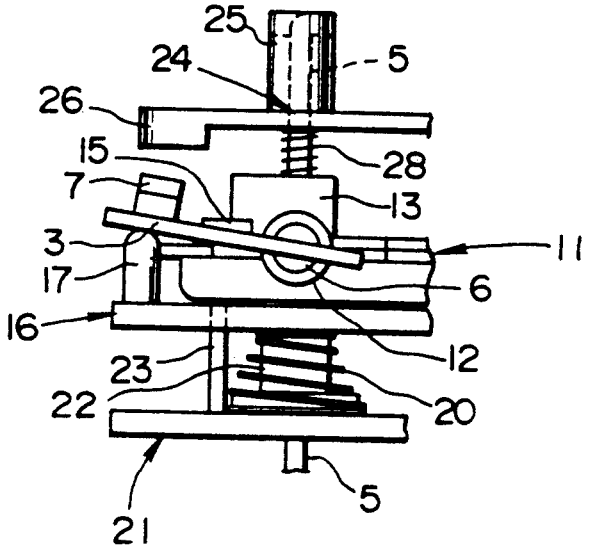
FIG. 3 is a fragmentary enlarged side elevational view of the attack-angle altering mechanism illustrated in FIG. 2, showing one of a plurality of rotor blades in a minus pitch.
Figure 4:
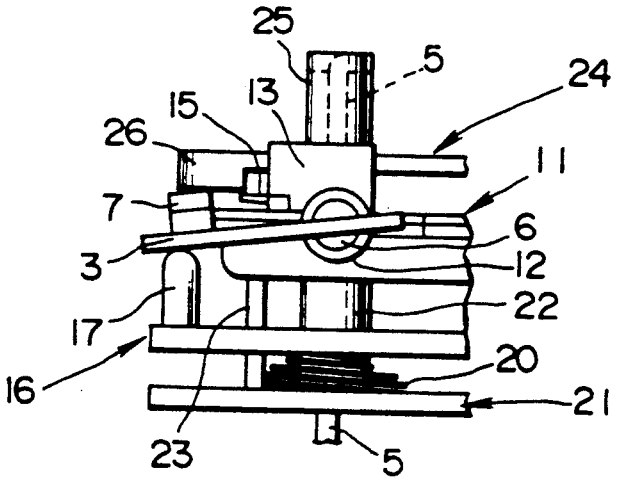
FIG. 4 is a view similar to FIG. 3, but showing the rotor blade in a plus pitch.

The rotor base 11, the pushing-up element 16, the pushing-up base 21 and the drive element 24 are assembled together as shown in FIGS. 3 and 4.

Specifically, a pushing-up coil spring 20 is arranged to be fitted about the base shaft 22 of the pushing-up base 21. The base shaft 22 extends through the through bore 18 in the pushing-up element 16 and is fitted in the engaging tube 13 of the rotor base 11. At this time, the detent rods 23 also extend respectively through the detent through bores 19 and are fixedly mounted to the lower surface of the rotor base 11. A drive shaft 5 having a reduced diameter is connected to the rubber material 29 of the power source 2. The drive shaft 5 extends through the base shaft 22 and the rotor base 11 and projects therefrom upwardly. A jumping coil spring 28 is fitted about the drive shaft 5. The drive shaft 5 extends through the drive connecting shaft 25 of the drive element 24. The drive shaft 5 has its forward end which is bent at a right angle. The bent forward end of the drive shaft 5 is engaged with one of a pair of drive connecting grooves 27 formed in the drive connecting shaft 25 so that the drive element 24 is mounted to the rotor base 11.

The operation of the helicopter toy constructed as above, according to the first embodiment of the invention, will be described.

Under such a condition that no twist is applied to the rubber material 29 of the power source 2, as shown in FIG. 3, the biasing force of the jumping spring 28 moves the drive element 24 upwardly. By the upward movement of the drive element 24, the engaging rods 26 are disengaged respectively from the engaging grooves 14 in the engaging tube 13 so that the rotor base 11, the pushing-up element 16 and the pushing-up base 21 are rotatable freely with respect to the drive shaft 5. In other words, the rotor blades 3 extend substantially horizontally, and are rotatable freely about the rotational axis. At this time, the pushing-up element 16 is pushed upwardly with respect to the pushing-up base 21 by the biasing force of the pushing-up spring 20. Thus, the pushing-up projections 17 on the pushing-up element 16 push up the side edges of the respective rotor blades 3 to maintain the same at their respective minus pitches in the descending direction. In this case, the angular movements of the respective rotor blades 3 are restricted to their respective predetermined locations by the upper-limit restricting projections 15. Thus, the rotor blades 3 are prevented to be brought to their respective extreme or excessive negative pitches.

When twist is applied to the rubber material 29 of the power source 2, the rubber material 29 per se is contracted in its length. Accordingly, the drive shaft 5 is pulled downwardly so that, as shown in FIG. 4, the drive element 24 is moved downwardly together with the drive shaft 5 against the biasing force of the jumping spring 28. Thus, if the engaging rods 26 of the drive element 24 are arranged respectively at locations engaged with the engaging grooves 14 of the engaging tube 13, pulling of the drive shaft 5 causes the engaging rods 26 to be engaged respectively with the engaging grooves 14. By doing so, the rotational force is transmitted to the rotor base 11 from the drive element 24. The forward ends of the respective engaging rods 26 push respectively the pushed projections 7 of the respective rotor blades 3. Thus, the angles of attack of the respective rotor blades 3 are altered to their respective positive pitches in the ascending or lifting direction, while the pushing-up element 16 is pushed down against the biasing force of the pushing-up spring 20.

As a result, during a period of time in which the twist releasing force of the rubber material 29 is generated, the drive element 24 is pulled by the drive shaft 5 in the manner described above. Accordingly, the rotor blades 3 are rotated about the rotational axis while the rotor blades 3 maintain their respective positive pitches, so that the flying body 1 ascends.

When the twist releasing force of the rubber material 29 is lost, the various elements are brought to the condition illustrated in FIG. 3 so that the rotor blades 3 are brought to their respective minus pitches, and are rotatable freely. Thus, since the power from the power source 2 is lost, the flying body 1 descends. At this time, however, since the rotor blades 3 are brought to their respective negative pitches, the rotor blades 3 continue to be rotated about the rotational axis by the air flow, so that the flying body 1 descends stably.

Figure 5:
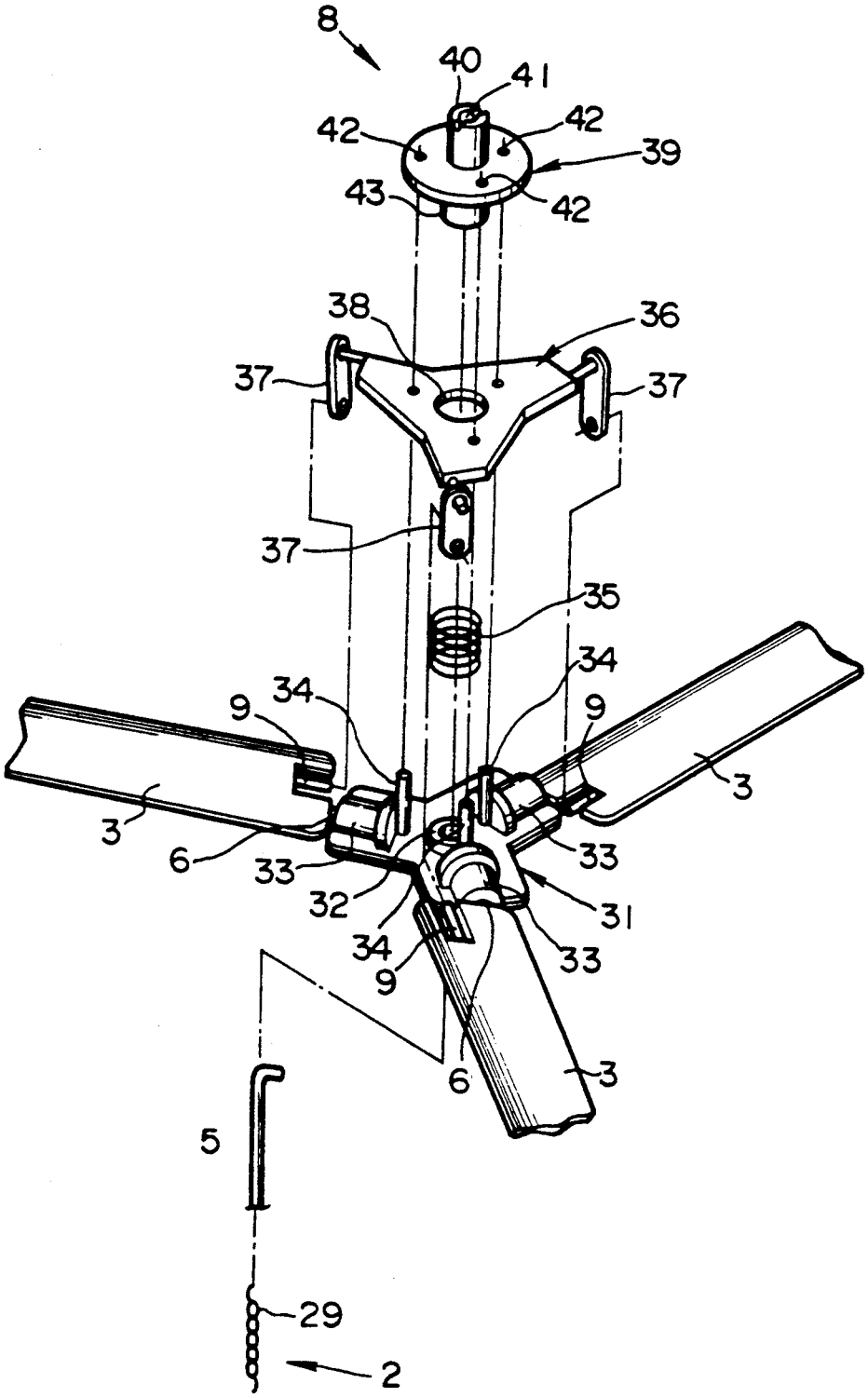
FIG. 5 is a view similar to FIG. 2, but showing an attack-angle altering mechanism in a helicopter toy according to a second embodiment of the invention.
Figure 6:
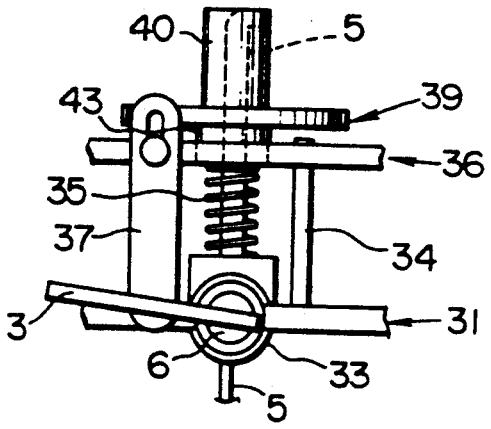
FIG. 6 is a fragmentary enlarged side elevational view of the attack-angle altering mechanism illustrated in FIG. 5, showing one of a plurality of rotor blades in a negative pitch.
Figure 7:
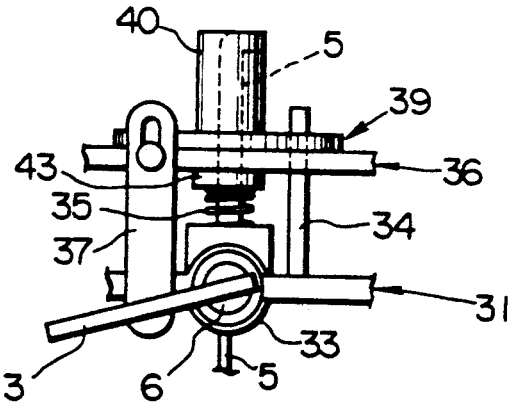
FIG. 7 is a view similar to FIG. 6, but showing the rotor blade in a plus pitch.

Referring to FIGS. 5 through 7, there is shown a helicopter toy according to a second embodiment of the invention. In FIGS. 5 through 7, components and parts like or similar to those illustrated in FIGS. 1 through 4 are designated by the same or like reference numerals, and the description of such like or similar components and parts will therefore be omitted to avoid repetition.

The helicopter toy comprises an attack-angle altering mechanism 8. In this connection, refer also to FIG. 1. As shown in FIG. 5, the attack-angle altering mechanism 8 includes a trifurcated rotor base 31. An engaging shaft 32 is provided at the center of the rotor base 31 and extends upwardly. The engaging shaft 32 is hollow having an inner periphery which forms a through bore. Shaft supports 33 are formed respectively at legs of the trifurcated rotor blade 31. The rotor blades 3 are supported respectively in the shaft supports 33 for angular movement about their respective pivotal axes so that the rotor blades 3 can be altered in pitch. Further, although not shown, springs or the like are suitably incorporated respectively in the shaft supports 33 to move the rotor blades 3 angularly about their respective pivotal axes. That is, biasing forces of the respective springs are applied respectively to the rotor blades 3 such that the angles of attack thereof are altered to their respective negative pitches.

Three detent rods 34 are mounted to the upper surface of the rotor base 31 in an upstanding manner. The rotor blades 3 have their respective base edges which are formed respectively with angular-movement engaging rods 9. The engaging rods 9 are engaged respectively with angle altering rods 37 subsequently to be described.

An angle altering element 36 is arranged above the rotor base 31, and is made of a trifurcated plate member having three legs. The aforesaid angle altering rods 37 have their one ends which are mounted respectively to the legs of the angle altering element 36 for angular movement about axes of the respective legs of the angle altering element 36. Each of the angle altering rods 37 is made of an elongated plate member to form a link. The angle altering element 36 is formed therein with detent bores through which the detent rods 34 of the rotor blades 31 extend respectively. Thus, the rotor base 31 and the angle altering element 36 are rotated together about the rotational axis. A through bore 38 is formed at the center of the angle altering element 36.

A drive element 39 made of a disc member is arranged above the angle altering element 36. A tubular drive connecting shaft 40 is provided at the center of the upper surface of the drive element 39. The drive connecting shaft 40 is hollow having an inner periphery which forms a through bore in the drive element 39. A tubular pushed guide shaft 43 is provided at the center of the lower surface of the drive element 39. The pushed guide shaft 43 is fitted in the through bore 38 in the angle altering element 36. The drive element 39 is formed therein with three engaging bores 42 which correspond in position respectively to the detent rods 34.

The drive element 39 is movable between an engaging position where the drive element 39 is engaged with the rotor blades 3 to bring the angles of attack of the respective rotor blades 3 to their respective positive pitches, and a disengaging position where the drive element 39 is disengaged from the rotor blades 3 to permit the angles of attack of the respective rotor blades 3 to be brought to their respective minus pitches. The angle altering element 36 is movable between a first position when the drive element 39 occupies the engaging position and a second position when the drive element 39 occupies the disengaging position. In the first position, the angle altering element 36 is pushed by the drive element 39 to move the rotor blades 3 to their respective plus pitches. In the second position, the angle altering element 36 permits the rotor blades 3 to be moved to their respective minus pitches.

The rotor base 31, the angle altering element 36 and the drive element 39 are assembled together as shown in FIGS. 6 and 7.

That is, the rotor blades 3 are supported by the rotor base 31. A jumping spring 35 is arranged to be fitted about the spring engaging shaft 32. The angle altering element 36 is arranged above the jumping spring 35 such that the detent rods 34 pass respectively through the detent bores in the angle altering element 36. At this time, the other ends of the respective angle altering rods 37 are engaged respectively with the angular-movement engaging rods 9 of the rotor blades 3. The drive element 39 is arranged above the angle altering element 36 such that the pushed guide shaft 43 is fitted in the through bore 38. The drive shaft 5 extends through the rotor base 31, the angle altering element 36 and the drive element 39, and projects from the drive connecting shaft 40. The forward end of the drive shaft 5 is bent at a right angle, and the bent forward end of the drive shaft 5 is engaged with one of a pair of recesses 41 formed in the drive element 39.

The operation of the helicopter toy constructed as above, according to the second embodiment of the invention, will be described below.

Under such a condition that twist is not applied to the rubber material 29 of the power source 2, as shown in FIG. 6, the biasing force of the jumping spring 35 moves the pushed guide shaft 43 upwardly. By upward movement of the pushed guide shaft 43, the drive element 39 is moved upwardly. By doing so, the rotor base 31 and the angle altering element 36 are freely rotatable about the rotational axis with respect to the drive shaft 5. In other words, the rotor blades 3 extend substantially horizontally, and are rotatable freely about the rotational axis. At this time, the forces are applied respectively to the rotor blades 3 by the springs in the shaft supports 33 such that the rotor blades 3 are moved angularly about their respective pivotal axes to their respective negative pitches. Accordingly, the angle altering rods 37 and the angle altering element 36 are pushed up. Thus, the angles of attack of the respective rotor blades 3 are maintained at the negative pitches in the descending direction.

When twist is applied to the rubber material 29 of the power source 2, the rubber material 29 per se is contracted in its length. Accordingly, the drive shaft 5 is pulled downwardly so that, as shown in FIG. 7, the drive element 39 is moved downwardly together with the drive shaft 5 against the biasing force of the jumping spring 35. Thus, the drive element 39 pushes down the angle altering element 36, and the rotor blades 3 are moved angularly about their respective pivotal axes such that the angles of attack of the respective rotor blades 3 are altered to their respective plus pitches. At this time, the detent rods 34 in conformity in position with the engaging bores 42 are fitted therein. By doing so, the rotational force is transmitted to the rotor base 31 from the drive element 39 so that the rotor blades 3 are rotated substantially horizontally about the rotational axis.

As a result, during a period of time in which the twist releasing force of the rubber material 29 is generated, the drive element 39 is pulled by the drive shaft 5. Accordingly, the rotor blades 3 are rotated about the rotational axis while the rotor blades 3 maintain their respective plus pitches, so that the flying body 1 ascends.

When the twist releasing force of the rubber material 29 is lost, the various elements are brought to the condition illustrated in FIG. 6 so that the rotor blades 3 are brought to their respective negative pitches, and are rotatable freely. Thus, since the power from the power source 2 is lost, the flying body 1 descends. At this time, however, since the rotor blades 3 are brought to their respective negative pitches, the rotor blades 3 continue to be rotated about the rotational axis, so that the flying body 1 descends stably.

What is claimed is:

1. A helicopter toy comprising:

a flying body;

a plurality of rotor blades mounted to said flying body for rotation about a rotational axis and for angular movement about their respective pivotal axes extending perpendicularly to said rotational axis so that said rotor blades have their respective angles of attack which can be altered in pitch;

a power source for giving a rotational force to said rotor blades to rotate the same about said rotational axis thereby climbing said flying body; and attack-angle altering means for altering the angles of attack of the respective rotor blades such that, when a power is transmitted to said rotor blades from said power source to rotate said rotor blades about the rotational axis, the angles of attack of the respective rotor blades are brought to their respective positive pitches to climb said flying body, while, when the transmission of the power from said power source to said rotor blades is released, the angles of attack of the respective rotor blades are brought to their respective negative pitches to cause said flying body to descend.

2. The helicopter toy according to claim 1, wherein said attack-angle altering means includes a rotor base having a plurality of shaft supports corresponding in number to said rotor blades, said rotor blades being supported respectively by said shaft supports for angular movement about the respective pivotal axes, a drive element movable between an engaging position where said drive element is engaged with said rotor blades to bring the angles of attack of the respective rotor blades to their respective positive pitches, and a disengaging position where said drive element is disengaged from said rotor blades to permit the angles of attack of the respective rotor blades to be brought to their respective negative pitches, and spring means arranged between said drive element and said rotor base for biasing said drive element to said disengaging position, said drive element being moved to said engaging position against a biasing force of said spring means.

3. The helicopter toy according to claim 2, further including shaft means having one end thereof drivingly connected to said power source, said shaft means extending through said rotor base and said drive element, the other end of said shaft means being engaged with said drive element for rotation therewith about said rotational axis.

4. The helicopter toy according to claim 3, wherein the other end of said shaft means is bent substantially at a right angle, and wherein said drive element is formed therein with recess means, said bent other end of said shaft means being engaged with said recess means in said drive element.

5. The helicopter toy according to claim 3, wherein said drive element has engaging means, and wherein, when said drive element occupies said engaging position, said engaging means of said drive element is engaged with said rotor blades to bring the angles of attack of the respective rotor blades to their respective positive pitches.

6. The helicopter toy according to claim 5, wherein said rotor blades have their respective engaged means which are located respectively adjacent said shaft supports, said engaging means of said drive element being engageable with said engaged means of the respective rotor blades.

7. The helicopter toy according to claim 6, wherein said attack-angle altering means further includes a pushing-up element arranged about said shaft means and in contact with said rotor blades, said pushing-up element being movable between a first position where said pushing-up element maintains said rotor blades at their respective negative pitches and a second position where said pushing-up element is pushed by said drive element through said engaged means of the respective rotor blades when said drive element occupies said engaging position, so that said rotor blades are moved to their respective positive pitches, and second spring means for biasing said pushing-up element to said first position, said pushing-up element being moved to said second position against a biasing force of said second spring means.

8. The helicopter toy according to claim 7, wherein said attack-angle altering means further includes a pushing-up base arranged about said shaft means, said pushing-up base having detent means through which said pushing-up element is connected to said pushing-up base for rotation therewith, said second spring means being arranged between said pushing-up element and said pushing-up base.

9. The helicopter toy according to claim 8, wherein said rotor base is arranged between said drive element and said pushing-up element, and said pushing-up element is arranged between said rotor base and said pushing-up base.

10. The helicopter toy according to claim 9, wherein said engaging means of said drive element includes a plurality of engaging pieces corresponding in number to a number of said rotor blades.

11. The helicopter toy according to claim 10, wherein said pushing-up element has a plurality of pushing-up projections corresponding in number to a number of said rotor blades, said pushing-up projections being engaged respectively with said rotor blades.

12. The helicopter toy according to claim 5, wherein said rotor base is formed therein with groove means, and wherein said engaging means of said drive element is engaged with said groove means in said rotor base when said drive element occupies said engaging position, so that said drive element is rotatable together with said rotor base about said rotational axis.

13. The helicopter toy according to claim 2, wherein said rotor base has restricting means for restricting upper limits of the negative pitches of the respective rotor blades.

14. The helicopter toy according to claim 13, wherein said restricting means of said rotor base has a plurality of restricting projections, said rotor blades being engaged respectively with said restricting projections so that the upper limits of the negative pitches of the respective rotor blades are restricted respectively by said restricting projections.

15. The helicopter toy according to claim 3, wherein said attack-angle altering means further includes an angle altering element arranged between said drive element and said rotor base and engaged with said rotor blades, said angle altering element being movable between a first position when said drive element occupies said engaging position and a second position when said drive element occupies said disengaging position, wherein, in said first position, said angle altering element is pushed by said drive element to move said rotor blades to their respective positive pitches, and wherein, in said second position, said angle altering element permits said rotor blades to be moved to their respective negative pitches, and spring means arranged between said rotor base and said drive element to move the same to said disengaging position, said drive element being moved to said engaging position against a biasing force of said spring means.

16. The helicopter toy according to claim 15, wherein said rotor base has detent means through which said drive element and said angle altering element are connected to said rotor base for rotation therewith.

17. The helicopter toy according to claim 16, wherein said angle altering element has a plurality of angle altering rods through which said angle altering element is connected respectively to said rotor blades.

18. The helicopter toy according to claim 17, wherein said rotor blades have their respective engaging pieces located adjacent said shaft supports, said angle altering rods having their respective one ends pivotally connected to said angle altering element and their respective other ends which are connected respectively to said engaging pieces of the respective rotor blades in a pivoting manner.

19. The helicopter toy according to claim 1, wherein said rotor blades are mounted to said flying body so as to extend substantially horizontally.

* * * * *